United States Patent [19]

Wolford

[11] 4,037,508

[45] July 26, 1977

[54] SNARE DRUM

[76] Inventor: John W. Wolford, P.O. Box 1024, Dundee, Fla. 33838

[21] Appl. No.: 701,951

[22] Filed: July 1, 1976

[51] Int. Cl.[2] ..... G10D 13/02

[52] U.S. Cl. ..... 84/415

[58] Field of Search ..... 84/411, 415, 416, 417

[56] References Cited

U.S. PATENT DOCUMENTS

| | | | |
|---|---|---|---|
| 2,285,269 | 6/1942 | Grolimund | 84/415 |
| 2,621,554 | 12/1952 | Way | 84/415 |
| 3,635,119 | 1/1972 | Thompson | 84/411 |
| 3,791,249 | 2/1974 | Frigo et al. | 84/411 |

*Primary Examiner*—Lawrence R. Franklin

[57] ABSTRACT

This invention relates to the musical drum art, and particularly to the orchestra snare drum and/or marching snare drum. The device compresses the moving air column produced when the batter head is struck, and directs the vibrating column to the proper area for maximum snare effect, livelier feel and sound, with far greater power and projection. This device brings the entire batter head to life, making it playable in all areas of its surface by eliminating the dead spots usually found in the center and around the edge of the head.

2 Claims, 3 Drawing Figures

SNARE DRUM

This invention relates to an accessory to be mounted entirely inside a snare drum, either orchestra or marching type.

The primary object of the invention is to provide a device of the type stated that directs the air column with sympathetic vibration to the musical heart of the instrument, at the same time eliminating the feed-back caused by the air column bouncing off the snare-head side and into conflict with following drum beat air columns.

Another object is to provide a one-piece plastic unit mounted internally of a snare drum that will eliminate all extra baggage now put on drums, such as super sensitive, dyna-sonic, etc., enabling the player to get better adjusting, tuning, etc., with less time involved and with better definition throughout the total area of the batter head, even to the bearing edge area.

These, and other objects of the invention, will become apparent from a reading of the following specification and claims, together with the accompanying drawing, wherein like parts are referred to and indicated by like reference numerals, and wherein:

Figure 1:
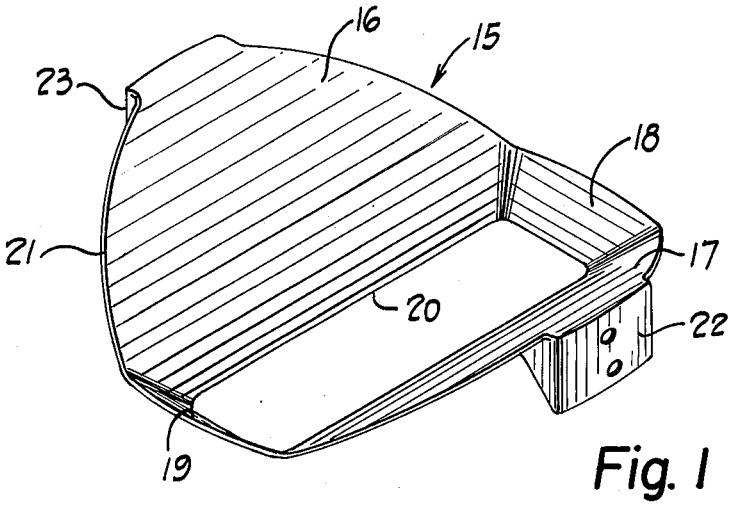
FIG. 1 is a perspective view of the ventrasonic acoustic-chamber that is the subject of the invention, in its unmounted condition.

Referring more particularly to the drawing, there is seen in FIG. 1 the ventrasonic acoustic-chamber that is the subject of the invention, broadly indicated by reference numeral 15, in its unmounted condition.

Figure 3:
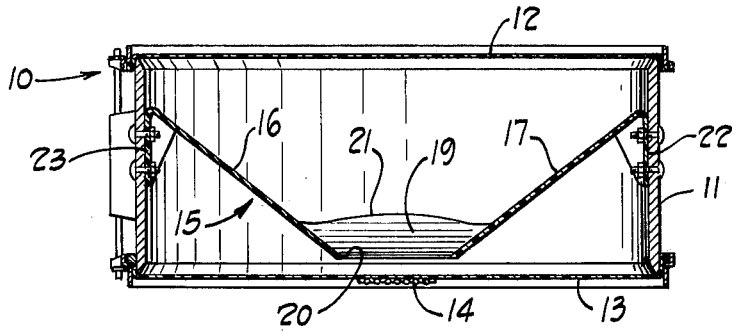

The unit 15 is preferably molded of clear plastic such as cellulose acetate butyrate, approximately ⅛ inch thick, and is adapted to interfit the interior of the snare drum 10 between the batter head 12 and the snare head 13, as seen in FIG. 3.

The ventrasonic acoustic-chamber 15 has an elongated orifice or vent 20, with upwardly projecting bounding side walls 16 and 17 joined through similarly upwardly projecting end walls 18 and 19.

The angular inclination of said walls is approximately 40°. Reference numeral 21 indicates the upper rim of the several walls.

Figure 2:
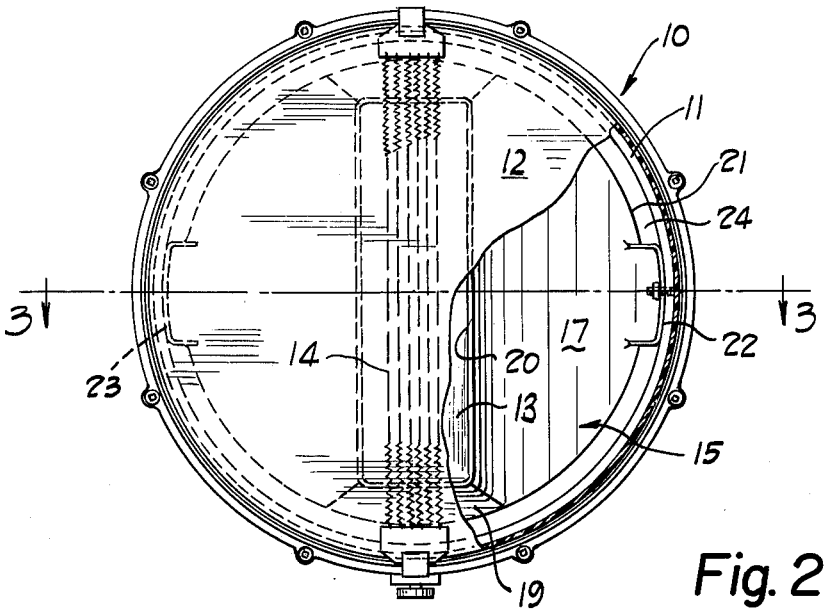
FIG. 2 is a top plan view of a snare drum having a portion of its batter head broken away to reveal the ventrasonic acoustic-chamber mounted therein; and, FIG. 3 is a vertical sectional view taken along the line and in the direction of the arrows 3—3 of FIG. 2.

The unit 15 is mounted within the drum shell 11, with the elongated vent 20 spaced upwardly approximately ½ inch from the snare head 13, as seen in FIG. 3, and aligned with the snare 14, a seen in FIG. 2.

The mounting lugs 22 and 23 are shaped to maintain a space of approximately ½ inch between the upper rim 21 of unit 15 and the drum side wall 11, as is seen most clearly in FIG. 2.

The dimensions of the unit 15 are dependent upon the size of the drum 10 in which it is mounted. Typical measurements for mounting in a 5 inch × 14 inch drum are as follows:

Diameter at upper rim 21 is 12 inches

Height, from orifice 20 to rim 21, at mounting lugs 22 and 23, is 4.05 inches Length of orifice 20 is 10.35 inches Width of orifice 20 is 2.72 inches When the batter head 12 is struck the compressed air column is directed through the orifice 20 for maximum snare effect.

After activating the snare head 13 the spent sound waves travel upwardly of the outer, or under surface of the unit walls, up to the rim 21.

Then the diffused waves re-enter the area of the batter head through the space 24 between the rim 21 and the drum wall 11, as seen in FIG. 2.

There is no inter-action between subsequent descending and returning air waves, such as causes the dead spots usually found in the center and around the edge of the batter head of conventional snare drums.

It will be understood that modifications and variations may be effected without departing from the spirit and scope of the novel concepts of the present invention.

I claim:

1. In combination with a snare drum, a ventrasonic acoustic-chamber adapted to interfit the interior of the snare drum between the batter and snare heads and clear of the drum shell, comprising;

a. a hollow circularly shaped body, open at the top and bottom, having angularly inclined side and end walls extending upwardly from a rectangularly shaped orifice at the lower edge thereof;

b. said bounding side and end walls being flat and outwardly inclined at an approximate 40° angle to the plane of the orifice;

c. the orifice being aligned with the snare and spaced upwardly of the snare head; and d. the upper rim of the side and end walls being spaced from the batter head and clear of the drum shell.

2. A ventrasonic acoustic-chamber according to claim 1 wherein the body is molded from cellulose acetate butyrate, of a uniform thickness within the limits of about one-eigth inch and one-quarter inch.

* * * * *